US005147150A

United States Patent [19]

Berkhout et al.

[11] Patent Number: 5,147,150

[45] Date of Patent: Sep. 15, 1992

[54] CELL STRUCTURE FOR GROUND CONSOLIDATION

[75] Inventors: Hendrik C. Berkhout, Arnhem; Paul A. Villerius, Delft, both of Netherlands

[73] Assignee: Akzo N.V., Netherlands

[21] Appl. No.: 540,481

[22] Filed: Jun. 19, 1990

[30] Foreign Application Priority Data

Jun. 19, 1989 [DE] Fed. Rep. of Germany ..... 3919902

[51] Int. Cl.[5] ..... E02D 17/20

[52] U.S. Cl. ..... 405/258; 405/16; 405/19

[58] Field of Search ..... 405/258, 15, 16, 19; 47/9

[56] References Cited

U.S. PATENT DOCUMENTS

| | | | |
|---|---|---|---|
| 4,530,622 | 7/1985 | Mercer | 405/258 |
| 4,572,705 | 2/1986 | Vignon et al. . | |
| 4,785,604 | 11/1988 | Johnson, Jr. . | |
| 4,798,498 | 1/1989 | Hallberg | 405/258 |
| 4,804,293 | 2/1989 | Varkonyi et al. . | |
| 4,815,963 | 3/1989 | Berkhout . | |
| 4,818,579 | 4/1989 | Uchida | 405/258 X |

FOREIGN PATENT DOCUMENTS

| | | | |
|---|---|---|---|
| 0260068 | 3/1988 | European Pat. Off. . | |
| 2603058 | 8/1977 | Fed. Rep. of Germany . | |
| 3021825 | 1/1982 | Fed. Rep. of Germany . | |
| 8015458 | 12/1983 | Fed. Rep. of Germany . | |
| 3519225 | 12/1986 | Fed. Rep. of Germany . | |
| 3700884 | 9/1987 | Fed. Rep. of Germany . | |
| 3722426 | 1/1989 | Fed. Rep. of Germany . | |
| 1091229 | 4/1955 | France . | |
| 2441685 | 6/1980 | France . | |
| 2577585 | of 1986 | France . | |
| 0016730 | 2/1981 | Japan | 405/258 |
| 0184131 | 11/1982 | Japan | 405/258 |
| WO88/07107 | 9/1988 | PCT Int'l Appl. . | |

OTHER PUBLICATIONS

DE-Z: Knaupe, W.: Anwendung von Geotextilien im Bauwesen. In: Bauplanung-Bautechnik, 34. Jg., H.12, Dez. 1982, S. 531-534.

DE-Z: Bauingenieur 63 (1988), H. 2, S. 92.

DE-Z: Umwelt & Technik Jan.-Feb. 1988, S. 35.

DE-Z: Umwett and Technik Sept., 1989, S. H.

*Primary Examiner*—Dennis L. Taylor

*Attorney, Agent, or Firm*—Oliff & Berridge

[57] ABSTRACT

A foldable cell structure is formed from water-permeable flexible strips whose width represents the height of the cells and which are connected to adjacent strips at intervals. An integral part of said cell structure is formed by strong stabilizing bands which, in the unfolded state of the cell structure, are arranged in straight lines and are at least predominantly parallel to one another, the cell structure preferably being formed by the unfolding of a water permeable sheet material provided with off-set, mutually parallel incisions of finite length. A further preferred embodiment of the cell structure has some of the water-permeable strips replaced or supplemented by stabilizing bands.

11 Claims, 3 Drawing Sheets

CELL STRUCTURE FOR GROUND CONSOLIDATION

BACKGROUND OF THE INVENTION

The invention relates to a foldable cell structure for consolidating and/or drying the ground, in particular on slopes.

Such a cell structure is known from U.S. Pat. No. 4,572,705, where the cell structure is formed by permeable and continuous strips, the actual cell structure being produced by unfolding the structure. To this end the strips are laid parallel to one another and connected to one another across the width. Adjacent strips can be connected to one another in such a way as to form rectangles or honeycombs in the extended state.

These cell structures are simple to manufacture and are also sufficiently strong for many applications to retain the soil material introduced into the cells.

In certain cases, for example when the ground onto which the structures are laid has low friction values or when very wide or very steep slopes are to be consolidated with soil, these known cell structures are not suitable, since the soil material introduced into the cells causes the cell structure to burst. The cell structures also burst if they are to be used for keeping soil in place on a waste disposal site which has been covered with a foil.

SUMMARY OF THE INVENTION

It is an object of the present invention to provide an improved foldable cell structure which is suitable for smooth and/or very steep ground. Another object is to provide a foldable cell structure which is also suitable for covering foil covered waste sites with a layer of soil for the purpose of protecting the cover foil and additionally, depending on the site, for rehabilitating the waste site.

The present invention is a foldable cell structure comprising at least two flexible stabilizing bands arranged substantially straight and parallel to one another in the unfolded state, and which are attached to one another at intervals by a flexible water-permeable strip whose width is the height of the cell structure.

DETAILED DESCRIPTION OF PREFERRED EMBODIMENTS

Figure 1:
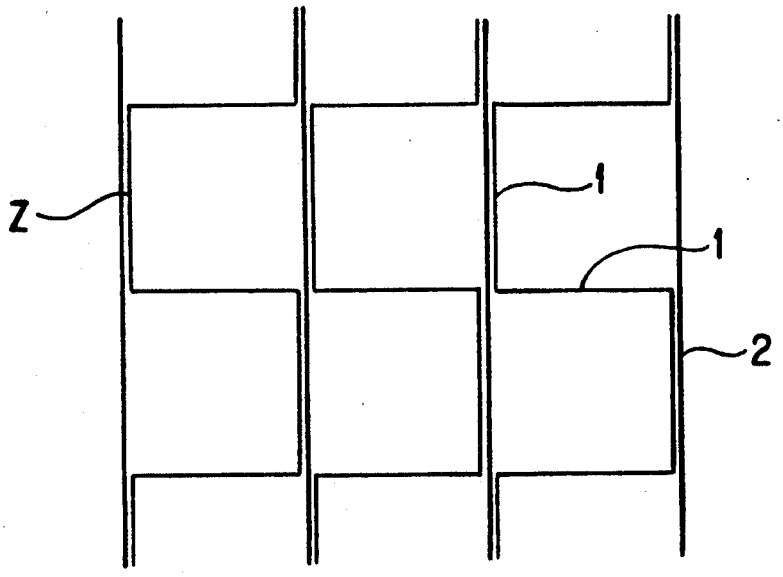
FIG. 1 shows an unfolded cell structure according to the invention.

As summarized above, the present invention achieves its objects by integrating into the cell structure strong stabilizing band which, in the unfolded state of the cell structure, are arranged in straight lines and are at least predominantly parallel to one another.

In particular, the stabilizing bands should have a tensile strength of from 0.5 to 500 kN/m, a creep elongation of less than 10%, preferably less than 5%, and/or an elongation at break of at most 20%.

The above-mentioned tensile strength is based on the width of the stabilizing bands. This means that given a tensile strength of 100 kN/m a stabilizing band which is 0.4 m in width has a tensile strength of 40 kN.

Sufficient stabilizing bands should be provided that the cell structure has a tensile strength in the slope direction of from 0.5 to 90 kN/m, preferably from 5 to 25 kN/m, the tensile strength in the unfolded state being measured per linear meter in the horizontal direction.

Creep elongation for the purposes of the present invention is the elongation undergone by a stabilizing band exposed for 2 years at room temperature and about 65% relative humidity to a load which corresponds to half of the breaking load of this stabilizing band.

It has been found to be advantageous for the cells of the cell structure to be approximately cuboid, the length of a cell being between 0.1 and 1 m, the width between 0.1 and 1 m and the height between 0.05 and 0.4 m.

In a preferred embodiment of the cell structure of the present invention, the stabilizing bands on one surface of the cell structure are connected to the longitudinal edges of the strips forming the cell structure. In this embodiment, the cell structure is unfolded on the ground in such a way that the stabilizing bands come to rest flat on the ground and thus do not prevent filling from above. The stabilizing bands should be aligned at right angles to be horizontal of the slope to utilize their tensile strength.

This manner of attaching stabilizing bands has proved particularly useful in the case of cell structures which are formed by unfolding a water-permeable sheet material provided with off-set, mutually parallel incisions of finite length. This structure is known per se from metal grid structures as a rib mesh. However, this form of structure was not possible with the prior art foldable cell structures since the strips forming the cell structure are flexible, on account of the required foldability, and thus, on unfolding, always collapse again and thus are hardly fillable. It is found, surprisingly, that attaching the strips to the underside favors the unfoldability. It is sufficient to unfold the bottommost layer, as a result of which the cell structure unfolds right to the top in a kind of chain reaction.

A further cell structure, which is particularly simple to handle, is formed from mutually parallel, continuous first strips on the one hand and second strips which extend at an angle to the first strips on the other, the first strips being the stabilizing bands between which the second strips are arranged and connected to the stabilizing bands. In particular, this cell structure should have triangular or rectangular preferably rectangular, cells. It will be readily understood that the triangular or rectangular cells referred to here are not - owing to the flexibility of the strips - exactly triangular or rectangular. In particular, the second strips, after filling, will no longer be straight but will sag between the stabilizing bands, which however does not in any way affect the functioning of the cell structure. In the cell structure known from U.S. Pat. No. 4,572,705, the specific form of interconnection of the cells does not make it possible to arrange the bands in straight lines. For example, in the case of rectangular cells the bands extend through the cell structure in stepped lines.

The triangular cell structure can be obtained in particular by arranging the second strips in a zigzag shape between the stabilizing bands. In this case, the edges of the zigzag spikes are each connected to the stabilizing bands. The connection between the bands is obtained in a manner known per se as described for example in U.S. Pat. No. 4,572,705.

If the zigzag shaped arrangement of the second strips is changed in such a way that the spiked edges are flattened and the flattened portions are connected to the stabilizing bands, the result is a trapezoidal arrangement of the second strips which has proved particularly useful in particular because there is a two-dimensional connection between the first and the second bands. It may be pointed out that the term trapezoidal arrangement also includes an arrangement where whichever is the second strip forms mutually orthogonal areas in a meander-shaped arrangement. This produces a rectangular cell structure.

According to the invention, it is also possible to provide the stabilizing bands in addition to the continuous first strips, in particular since the stabilizing bands do not need to have the same width as the strips.

Figure 2A:
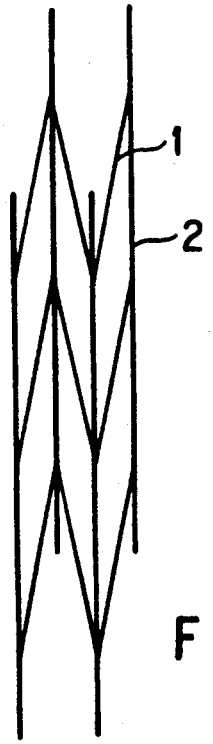
FIGS. 2*a* and 2*b* show the cell structure illustrated in FIG. 1 in the almost folded state.
Figure 2B:
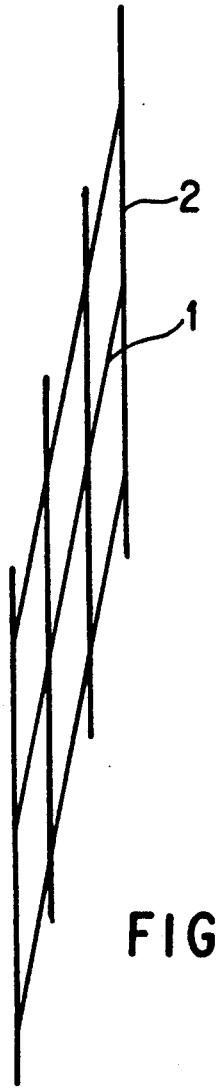

The invention is further illustrated by reference to the drawings. Thus, FIG. 1 is a plan view of a cell structure of square cross-section. The cell structure is formed from stabilizing bands 2 and strip webs 1. It is shown systematically in FIGS. 2*a* and 2*b* how the cell structure of FIG. 1 can be folded. It is favorable if the strip webs 1 are each in a meander-shaped arrangement and so connected to the stabilizing bands 2. To illustrate the position of the strip web 1 along the stabilizing bands 2, FIG. 1 shows an interspace Z between strip web 1 and stabilizing band 2 which in the depicted cell structure serves as a bonding area between strip web 1 and stabilizing band 2.

Figure 3:
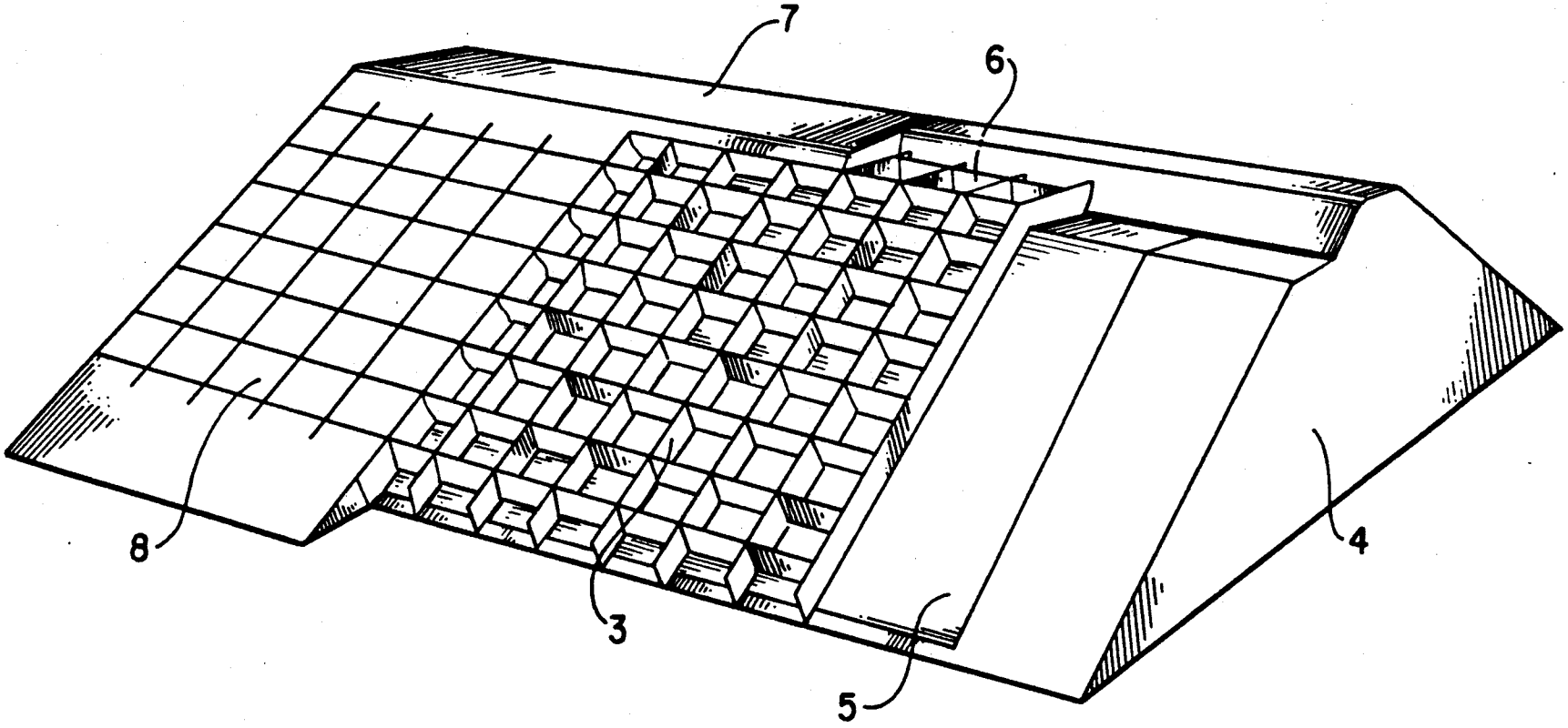
FIG. 3 shows the arrangement of a cell structure according to the invention on a foil covered waste site.

FIG. 3 shows how the cell structure according to the invention can be used to cover a waste disposal site. The waste mound 4 is covered with a sheet 5 to seal off the waste disposal site. The cell structure according to the invention is laid out on this sheet and unfolded, so that the stabilizing bands 3 are arranged at right angles to the slope horizontal and are connected to one another via second strips 6. This cell structure is filled with earth to protect the sheet 5 and to rehabilitate the waste disposal site, forming a closed earth formation 7, 8 which is held by the cell structure 3, 6. In this formation, the front slope 8 forms a counterweight to the back slope and vice versa, so that, despite the sliding properties of the sheet 5 and the weight of the earth fill, a stable soil structure is made possible by the cell structure 3, 6 according to the invention. If the upper surface 7 of a mound to be filled extends over a wide area, it is in general sufficient to arrange for the cell structure 3, 6 to extend into the upper surface for a few meters since the fill acts as a counterweight for the cell structure 3, 6.

Figure 4:
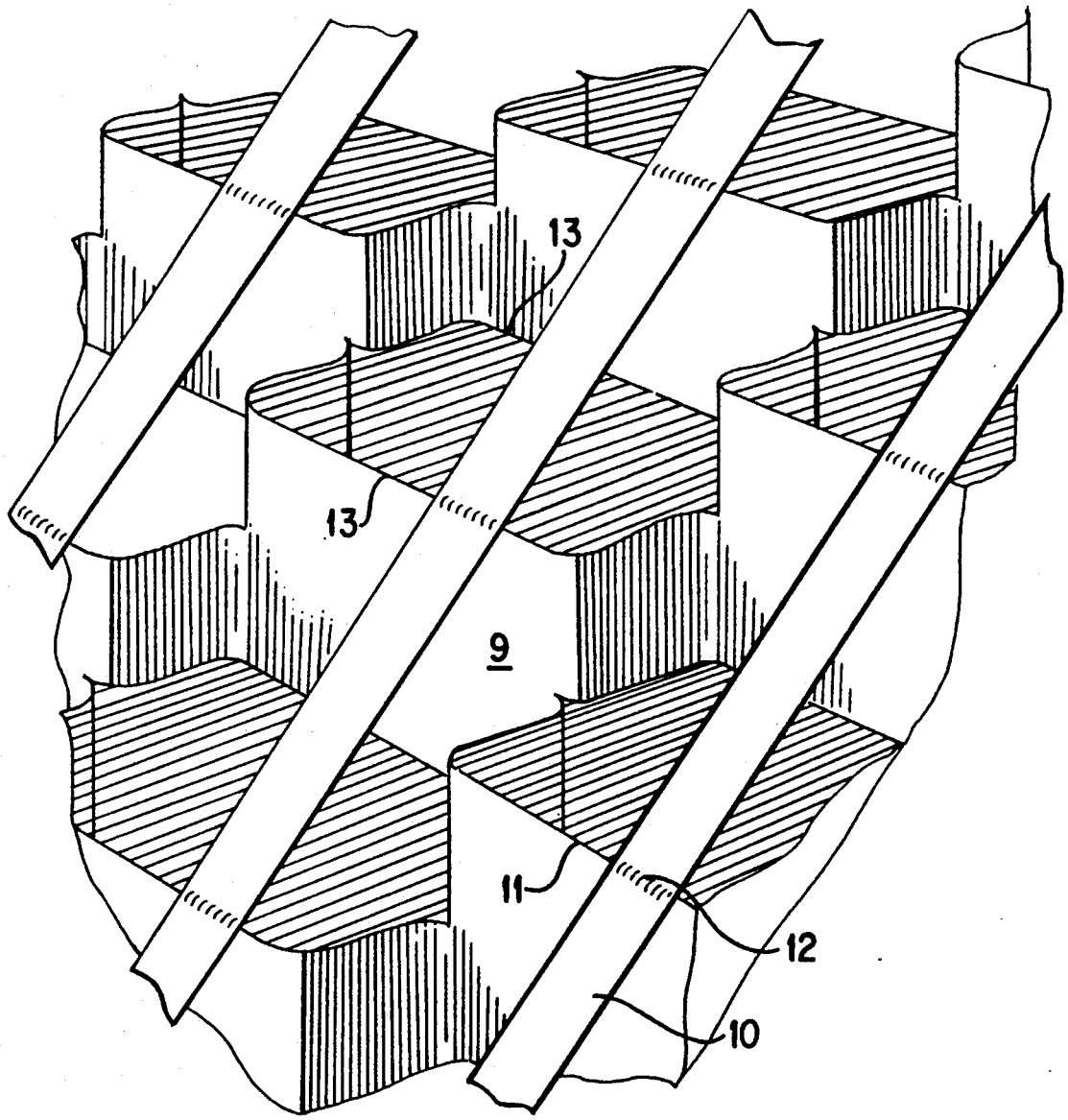
FIG. 4 is a schematic diagram of an unfolded cell structure according to another embodiment of the invention.

FIG. 4 depicts a cell structure formed by the unfolding of a water-permeable, flexible sheet material 9 provided with off-set, mutually at least approximately parallel incisions of finite length. The cell structure is shown from below, with stabilizing bands 10 bonded together via the longitudinal edges 11 of the cell structure, for example via adhesive seam 12. The two longitudinal edges 13 are side by side in the folded state and were produced by a straight-line incision in the sheet material 9. The underside surfaces of the resulting empty spaces to be filled are shown hatched in the figure for clarity. In the folded state the embodiment of the cell structure according to the invention shown in FIG. 4 is a planar sheet material on which the stabilizing band 10 is connected at an incision edge 13 via junction sites 12 and folded between two junction points 12 on account of its overlength. Such a sheet material is easy to roll up.

What is claimed is:

1. A foldable cell-structure comprising;

a sheet material provided with off-set, mutually, at least approximately parallel incisions of finite length to form strips; and at least two stabilizing bands arranged substantially straight and parallel to one another and attached to longitudinal edges of the incisions such that the strips of the sheet material form cells whose height is the width of the strips and the stabilizing bands stabilized the cells.

2. The cell structure of claim 1, wherein the stabilizing bands have a tensile strength of from 0.5 to 500 kN/m.

3. The cell structure of claim 1, wherein the stabilizing bands have a creep elongation of less than 10%.

4. The cell structure of claim 1, having a tensile strength of from 0.5 to 90 kN/m.

5. The cell structure of claim 1, wherein the stabilizing bands have an elongation at break of at most 20%.

6. The cell structure of claim 1, wherein the stabilizing bands on one surface of the cell structure are connected to the longitudinal edges of the strip.

7. The cell structure of claim 3, wherein said creep elongation does not exceed 5%.

8. The cell structure of claim 4, wherein said tensile strength ranges from 5 to 25 kN/m.

9. The cell structure of claim 1, having a plurality of water-permeable strips.

10. The cell structure of claim 9, wherein at least one of said water-permeable strips is replaced or supplemented by said stabilizing bands.

11. The sheet material according to claim 1, wherein the sheet material is water permeable.

* * * * *